US006313805B1

(12) United States Patent
Nishiyama

(10) Patent No.: US 6,313,805 B1
(45) Date of Patent: Nov. 6, 2001

(54) WIDE RANGE AZIMUTH DRIVING SYSTEM FOR SATELLITE COMMUNICATION ANTENNA

(75) Inventor: Hiroshi Nishiyama, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/676,996

(22) Filed: Sep. 29, 2000

(30) Foreign Application Priority Data

Sep. 30, 1999 (JP) ..... 11-279548

(51) Int. Cl.[7] ..... H01Q 13/00; H01Q 3/02
(52) U.S. Cl. ..... 343/766; 343/882
(58) Field of Search ..... 343/757, 761, 343/762, 766, 765, 878, 882

(56) References Cited

U.S. PATENT DOCUMENTS 3,624,656 * 11/1971 Kaschak ..... 343/762
4,204,214 * 5/1980 Fassnacht ..... 343/766
4,312,002 * 1/1982 Stewart ..... 343/761
5,245,351 * 9/1993 Chou ..... 343/766
6,023,247 * 2/2000 Rodeffer ..... 343/765

* cited by examiner

*Primary Examiner*—Don Wong
*Assistant Examiner*—Hoang Nguyen
(74) *Attorney, Agent, or Firm*—Ostrolenk, Faber, Gerb & Soffen, LLP

(57) ABSTRACT

It is an object of the present invention to provide a wide range azimuth (AZ) driving system for an antenna which has a simple structure and enables costs to be lowered and a producing time to be short. A first worm reducer which is connected to a worm shaft of a motor and a second worm reducer which is intermittently driven by the worm shaft and a clutch are provided, and gears of the two worm reducers engage with a large gear which is arranged to an antenna yoke. Further, one motor can arbitrarily control backlash and both wide range driving at a high speed and tracking driving with high precision are simultaneously possible by properly controlling the clutch and the motor.

20 Claims, 10 Drawing Sheets

START
S31
CLUTCH OFF
S32
SUPPRESS BACKLASH
S33
CLUTCH ON
ASSURE INITIAL STATE

WIDE RANGE DRIVING
S41
CLUTCH OFF
S42
GENERATE BACKLASH
S43
CLUTCH ON
S44
WIDE RANGE AZ DRIVING
S45
CLUTCH OFF
S46
SUPPRESS BACKLASH
S47
CLUTCH ON
END OF WIDE RANGE DRIVING

TRACKING DRIVING
S51
DRIVE MOTOR IN DESIGNATED DIRECTION
S52
DESIGNATED DIRECTION ?
N
Y
S53
STOP MOTOR
END OF TRACKING DRIVING

WIDE RANGE AZIMUTH DRIVING SYSTEM FOR SATELLITE COMMUNICATION ANTENNA

BACKGROUND OF THE INVENTION

1. Field of the Invention

The present invention relates to a wide range azimuth (AZ) driving system for a satellite communication antenna which is set at an earth station of a satellite communication system, and more particularly, to a wide range azimuth (AZ) driving system for an antenna in view of driving at a low speed for tracking of a geostationary satellite and driving at a high speed for re-positioning.

2. Description of the Related Art

Hitherto, the wide range azimuth (AZ) driving system for the antenna is used as a wide range azimuth (AZ) driving system for a satellite communication antenna which is set at an earth station of a satellite communication system using, for example, a geostationary satellite shown in FIG. 1.

Systems such as INTELSAT (Internal Telecommunications Satellite Consortium) and INMARSAT (International Maritime Satellite Organization) are well known as satellite communication systems to which the antenna is applied.

As shown in FIG. 1, a wide range azimuth (AZ) driving device 13 for an antenna as the above-mentioned system is disposed at a base portion of a yoke for supporting an antenna 9 and drives the antenna 9 in the azimuth (AZ) direction.

As an example of the outline of a size in a system which is put into practical use, an aperture diameter D1 of the antenna 9 is within a range of approximately 3.6 (m) as one of a small size to 18 (m) as one of a maximum size and a main body of the antenna 9 is approximately 16 (t) in weight at the maximum. A diameter D2 of a large gear 10 is approximately 1.8 (m).

As one example of the size in antennas which are widely used, the aperture diameter D1 of the antenna 9 is approximately 10 (m), the main body of the antenna 9 is approximately 4 (t) in weight, and the diameter D2 of the large gear 10 is approximately 1.2 (m).

The antenna in the satellite communication system is driven in the azimuth (AZ) direction by the following two operations.

According to a first operation, an antenna is azimuthally (AZ) driven by switching geostationary satellites which communicate data. The geostationary satellite communication system comprises a plurality of geostationary satellites and data which is communicated every satellite is different. As shown in FIG. 1, the antenna 9 which communicates data with an A geostationary satellite 14-1 is azimuthally (AZ) driven in a direction (shown by reference numeral 9' in FIG. 1) of a B geostationary satellite 14-2 so as to communicate another data. The operation is called as wide range driving.

The wide range driving requires that a target satellite is acquired as quickly as possible. Therefore, the antenna 9 also requires driving at a high speed throughout a wide range.

According to a second operation, an antenna is azimuthally (AZ) driven so as to track a satellite which the antenna acquires. The position of the geostationary satellite which is seen from the earth always changes by the deviation from an orbit. FIG. 2 shows a state of the change in the position of the satellite which is seen from the earth. This is called as 8-shaped movement of the satellite, the satellite draws an 8-shaped locus on one-day cycle while the position at which the satellite should inherently remain stationary is central. As one example, an azimuth (AZ) tracking range (azimuth range) of the 8-shaped movement is approximately 6° in the azimuth (AZ) direction at the maximum.

However, a range of directional characteristics (azimuth range) of the aforementioned antennas which are generally used is 0.024°, that is, remarkably narrow, as one example of the systems which are put into practical use.

Therefore, if the antenna acquires the satellite once, the satellite deviates from the orbit by the 8-shaped movement and, thus, deviates from the range of the directional characteristics of the antenna and cannot maintain a predetermined antenna gain continuously.

Then, the antenna is driven in the azimuth (AZ) direction in accordance with the 8-shaped movement of the satellite and tracks the satellite. The operation is called as tracking driving.

The tracking driving requires that the azimuth of the antenna is accurately controlled. Accordingly, it is necessary to suppress backlash of a gear of a driving system.

Incidentally, referring to FIG. 2, the 8-shaped movement of the satellite includes not only the displacement of the azimuth (AZ) direction but also the displacement in the elevation (EL) direction. However, the present invention includes no driving of tracking in the elevation (EL) direction and the description is omitted.

FIG. 3 is a structural diagram illustrating one example of wide range azimuth (AZ) driving systems for an antenna according to a conventional technique which is used for the operations.

Referring to FIG. 3, the wide range azimuth (AZ) driving system for the antenna according to the conventional technique comprises one large gear 10, an A small gear 1 and a B small gear 3 for driving the large gear 10, two gear reducers of an A small gear 15-1 and a B small gear 15-2, two motors of an A motor 16-1 and a B motor 16-2, two clutches of an A clutch 5-1 and a B clutch 5-2 for connecting/disconnecting the A gear reducer 15-1 and the B gear reducer 15-2 to the A motor 16-1 and the B motor 16-2, an antenna control unit (ACU) 19, a torque bias adding circuit (TB) 17, and two servo amplifies of an A servo amplifier 18-1 and a B servo amplifier 18-2.

The ACU 19 is instructed on the azimuth to which the antenna 9 is directed from the outside, and instructs the A servo amplifier 18-1 and the B servo amplifier 18-2 on the rotational direction, rotational speed, and stop of the A motor 16-1 and the B motor 16-2. The ACU 19 also detects the azimuth (AZ) direction to which the antenna 9 is directed. As one example of the systems which are put into practical use, the ACU 19 has performance for detecting the azimuth (AZ) direction with precision of a level ranging from 1/100° to 1/1000°. Specifically speaking, the azimuth (AZ) direction is determined every system in accordance with the range of the directional characteristics of the antenna (azimuth range).

The TB 17 measures consumption currents of the two motors of the A motor 16-land the B motor 16-2, thereby detecting loads of the A motor 16-1 and the B motor 16-2 and controlling the A servo amplifier 18-1 and the B servo amplifier 18-2 so as to cause torque biases in the two motors.

The torque bias will be simply described. According to the structure shown in FIG. 3, the A motor 16-1 and the B motor 16-2 suppress backlash which is caused among the A small gear 1, the B small gear 3, and the large gear 10 by causing a torque bias when the azimuth of the antenna is maintained and the tracking by the antenna 9 is driven.

When the azimuth (AZ) direction of the antenna 9 is maintained, the ACU 19 controls the A servo amplifier 18-1 and the B servo amplifier 18-2 so as to stop the A motor 16-1 and the B motor 16-2. The TB 17 controls the A servo amplifiers 18-1 and the B servo amplifier 18-2 so that the A motor 16-1 and the B motor 16-2 generate driving forces having a predetermined intensities which are mutually directed in the opposite direction. Thus, the A servo amplifier 18-1 drives the A motor 16-1 that, for instance, the A motor 16-1 rotates in the right direction and the B servo amplifier 18-2 drives the B motor 16-2 that, for instance, the B motor 16-2 rotates in the left direction. The TB 17 detects the loads of the motors and controls the motors so that the mutual driving forces are balanced. Accordingly, the backlash is suppressed and the azimuth of the antenna 9 is precisely maintained. The driving force is called as a torque bias.

Incidentally, the A clutch 5-1 and the B clutch 5-2 are provided for purpose of disconnecting a troubled motor to the reducers, mainly when the motor is troubled. Therefore, during the normal operation, the operation for controlling that the motors are connected to the reducers and, consequently, the detailed description is omitted.

Next, the operation of FIG. 3 will be described with reference to FIGS. 4*a* to 4*c*.

FIGS. 4*a* to 4*c* illustrate the control sequence of the ACU 19 in the FIG. 3.

Referring to FIG. 4*a*, when the system is started, the ACU 19 connects the A clutch 5-1 and the B clutch 5-2 to the A motor 16-1 and the B motor 16-2 (step S61), the A motor 16-1 and the B motor 16-2 are stopped (step S62), and the TB 17 is controlled and a torque bias is added (step S63).

Thus, the A motor 16-1 and the B motor 16-2 are connected to the A gear reducer 15-1 and the B gear reducer 15-2, respectively. The A motor 16-1 and the B motor 16-2 generate torque biases. The backlash between the A small gear 1 and B small gear 3 and the large gear 10 is suppressed and the antenna becomes stationary. This results in assuring the initial state.

Next, the operation of the wide range driving for acquiring the satellite will be described.

When the direction to which the antenna is directed is instructed, the ACU 19 detects the current direction to which the antenna 9 is directed and calculates necessary rotational direction and rotational angle. If the rotational angle is larger than a certain extent thereof, the wide range driving is controlled.

Referring to FIG. 4*b*, the torque bias is first reset when the wide range driving (step S71). Because no communication is performed during the wide range driving, the direction to which the antenna 9 is directed needs no precision. Sequentially, the A motor 16-1 and the B motor 16-2 are driven in the designated direction at a high speed (step S72). The direction to which the antenna 9 is directed is detected (step S73). When the antenna 9 is directed in the designated direction, the A motor 16-1 and the B motor 16-2 are stopped (step S74). The torque bias is added (step S75), and the wide range driving ends.

Obviously, in case of the actual azimuth (AZ) driving for the antenna, it is necessary to properly control the acceleration and the deceleration of the A motor 16-1 and the B motor 16-2 when the wide range driving is started and stopped so as to properly suppress the moment of inertia which derives from the weight of the antenna and to correctly assure a target direction. However, this is a well-known technique and the detailed description is herein omitted.

Subsequently, the description is given to the operation of tracking driving for tracking the satellite.

When the direction to which the antenna 9 should be directed is instructed, the ACU 19 detects the direction to which the antenna 9 is currently directed and calculates the rotational direction and the rotational angle. If the rotational angle is larger than a certain extent thereof, the tracking driving is controlled.

Referring to FIG. 4*c*, the A motor 16-1 and the B motor 16-2 are driven at a predetermined low speed during the tracking driving (step S81), and the direction to which the antenna 9 is directed is detected (step S82). When the antenna 9 is directed in the designated direction, the A motor 16-1 and the B motor 16-2 are stopped (step S83).

The communication through the antenna 9 is continued during the tracking driving, so that the torque bias is continuously added because of driving with high precision.

The detailed description is given to the operation when the A servo amplifier 18-1 and the B servo amplifier 18-2 are simultaneously controlled by both the ACU 19 and the TB 17 in the case in which the ACU 19 is instructed on the direction to which the antenna 9 is directed and drives the tracking of the antenna 9.

Before start of the tracking driving, the large gear 10 becomes stationary in a state in which the backlash is absent and the A motor 16-1 and B motor 16-2 mutually adds a torque bias. It is assumed that the A small gear 1, the B small gear 3, the A motor 16-1, and the B motor 16-2 rotate in the left direction by the tracking driving, and the A motor 16-1 and the B motor 16-2 are DC motors, and drive voltages of the motors are positive when rotating in the left direction. It is also assumed that A servo amplifier 18-1 outputs a drive voltage −VT (V) and the B servo amplifier 18-2 outputs a drive voltage +VT (V) due to the addition of the torque bias.

When the start of the tracking operation, the ACU 19 rotates both the A servo amplifier 18-1 and the B servo amplifier 18-2 in the left direction, instructs the rotational speed corresponding to the calculated rotational angle, and controls the driving of the A motor 16-1 and the B motor 16-2. It is assumed that under the control operation by the ACU 19, the drive voltages which are inputted to the A servo amplifier 18-1 and the B servo amplifier 18-2 are VL (V).

The A servo amplifier 18-1 and the B servo amplifier 18-2 add the torque bias by the TB 17 to the motor drive voltage by the ACU 19 and output a drive voltage VD.

Therefore, when an output drive voltage of the A-servo amplifier 18-1 is VD1, $$\mathrm{VD1}=VL-VT(V) \tag{1}$$

Similarly, an output drive voltage of the B servo amplifier 18-2 is VD2, $$\mathrm{VD2}=VL+VT\ (V) \tag{2}$$

According to the structure of FIG. 3, the antenna is driven in the azimuth (AZ) direction while the torque bias is imparted during the tracking driving and the backlash of the large gear 10 is suppressed.

As mentioned above, the conventional geostationary satellite communication system acquires and tracks any desired geostationary satellite by using the azimuth (AZ) driving system for the antenna and communicates data.

The foregoing wide range azimuth (AZ) driving system for the antenna according to the conventional technique comprises the two motors of the A motor 16-1 and the B motor 16-2 and the two-system driving-mechanism corresponding thereto and, therefore, the structure is complicated. Because opposite-polarized torque biases are imparted to the two motors and the backlash of the two driving systems are controlled to be suppressed.

The opposite-polarized torque biases are imparted to the two motors and the backlash of the two driving systems is suppressed and, therefore, the TB 17, the A servo amplifier 18-1, and the B servo amplifier 18-2 are necessary and the structure becomes complicated. This causes a serious problem in the case in which costs are reduced.

Further, since the performances of the motors are individually varied every motor, the relationship between the load (consumption current value) of the motor which is detected by the TB 17 and the driving force which is generated by the motor is not uniform, depending on the system. The imparting amount of torque bias has to be adjusted every system in view of the balance of driving forces of the two motors. This work needs a high-level technique and a long time and causes a serious problem in the case of completing the system for a short time.

SUMMARY OF THE INVENTION

It is an object of the present invention to provide a wide range azimuth (AZ) driving system for an antenna which is simply structured and enables costs to decreased and a producing time to be shortened.

The wide range azimuth (AZ) driving system for the antenna of the present invention includes two worm reducers for driving a large gear which is disposed at an antenna tower, one motor, and one clutch. A rotary shaft of the motor is connected to a first worm reducer. The first worm reducer reduces a driving force of the motor by a worm reducing mechanism and drives a first small gear, and the first small gear drives the large gear. The rotary shaft of the motor drives the first worm reducer, penetrates through the first worm reducer, and is connected to the clutch. The clutch connects/disconnects the driving force of the motor and transmits the driving force to a driving shaft of a second worm reducer. The second worm reducer reduces the driving force of the motor by a worm reducing mechanism similar to that of the first worm reducer and drives a second small gear. The second small gear drives the large gear. According to the wide range azimuth (AZ) driving system for the antenna of the present invention, the clutch is properly connected/disconnected in accordance with a condition in advance when the motor is driven, backlash between the first and second small gears and the large gear is arbitrarily controlled by using a self-locking function of the worm reducers. In other words, in the case of the wide range driving which requires no precision in the direction to which the antenna is directed, the control operation is executed so that a proper amount of backlash is generated in advance, thereby, the antenna can once rotate throughout the wide range if working precision of the large gear is not so high. In the case of tracking driving in the case of which high precision is required for the control operation of the direction to which the antenna is directed and the range of the azimuth (AZ) tracking of the antenna is narrow, the control operation is executed so that the backlash is suppressed in advance. Thus, an error of the direction to which the antenna is directed is finely suppressed.

Accordingly, the wide range azimuth (AZ) driving system for the antenna of the present invention has a simple construction and enables both the wide range driving operation at a high speed and the tracking operation with high precision.

BRIEF DESCRIPTION OF THE DRAWINGS

The above and other objects, features and advantages of the present invention will become more apparent from the following detailed description when taken in conjunction with the accompanying drawings wherein.

DETAILED DESCRIPTION OF THE PREFERRED EMBODIMENTS

A first embodiment of the present invention will be described hereinbelow with reference to the drawings.

Figure 1:
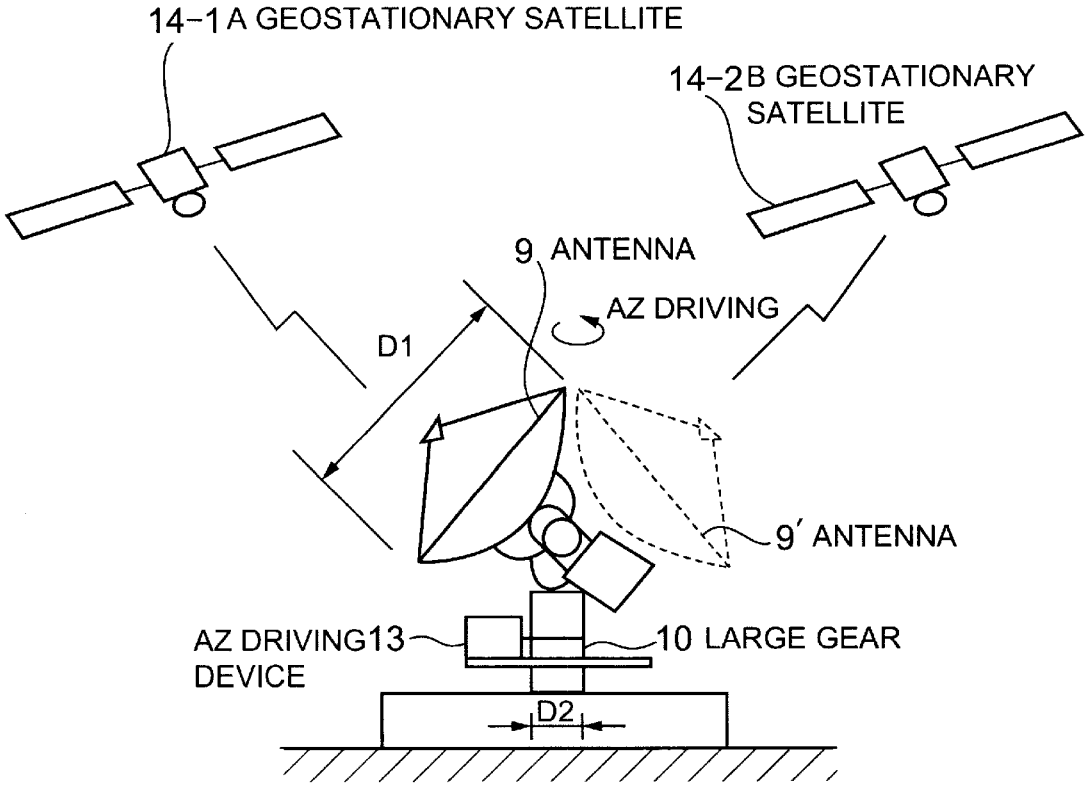
FIG.1 (PRIOR ART)
FIG. 1 is an illustrative diagram for illustrating the outline of a satellite communication system using the conventional wide range azimuth (AZ) driving system for an antenna.
Figure 2:
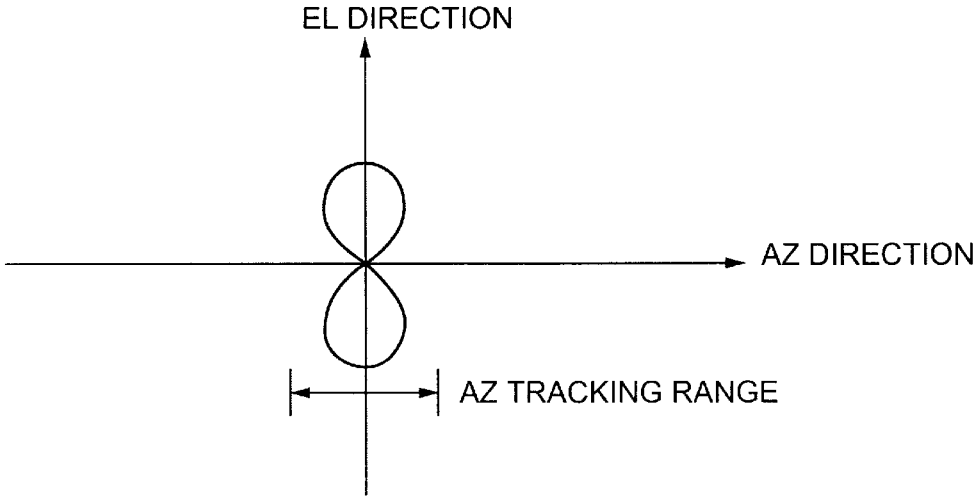
FIG.2 (PRIOR ART)
FIG. 2 is an illustrative diagram for illustrating an 8-shaped movement of a geostationary satellite in a satellite communication system using the wide range azimuth (AZ) driving system for the antenna.
Figure 3:
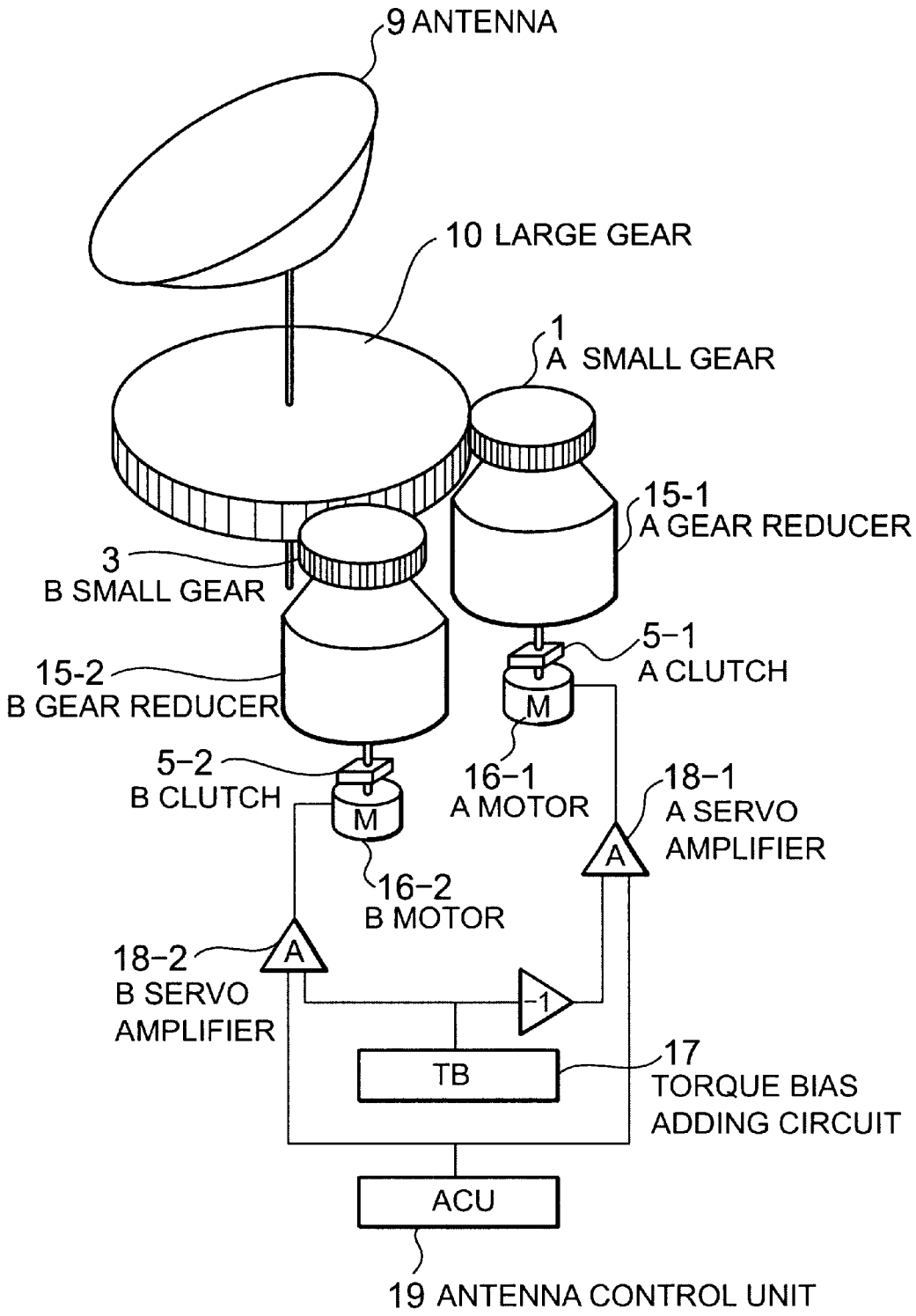
FIG.3 (PRIOR ART)
FIG. 3 is a structural diagram of a wide range azimuth (AZ) driving system for the antenna according to a conventional technique.
Figures 4A, 4B, 4C:
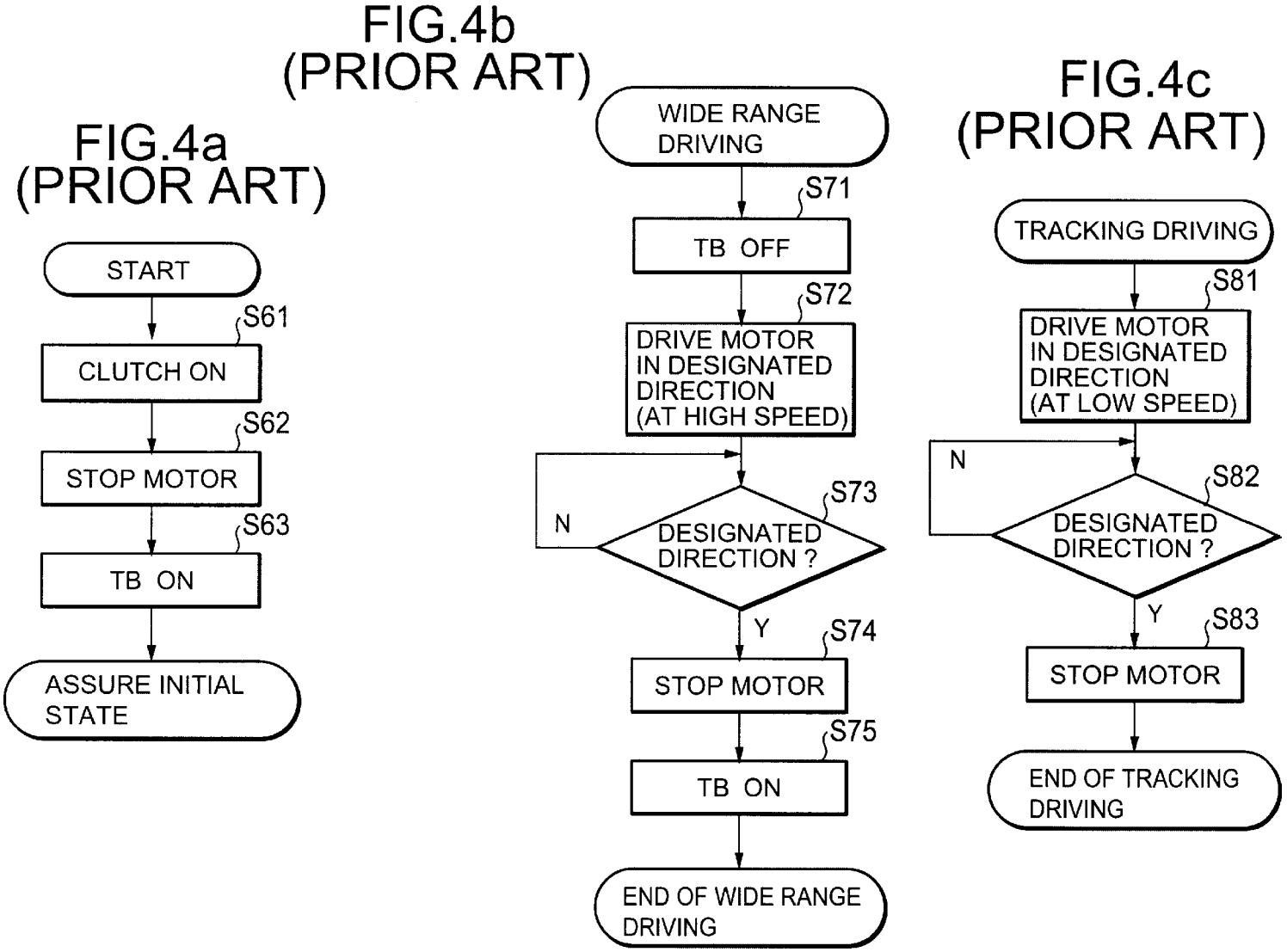
FIG.4a (PRIOR ART)
FIG.4b (PRIOR ART)
FIG.4c (PRIOR ART)
FIG. 4*a* is a flowchart showing a control sequence by an ACU 19 when start of the wide range azimuth (AZ) driving system for the antenna according to the conventional technique.
FIG. 4*b* is a flowchart showing a control sequence by the ACU 19 when wide range driving of the wide range azimuth (AZ) driving system for the antenna according to the conventional technique.
FIG. 4*c* is a flowchart showing a control sequence by the ACU 19 when tracking driving of the wide range azimuth (AZ) driving system for the antenna according to the conventional technique.
Figure 5:
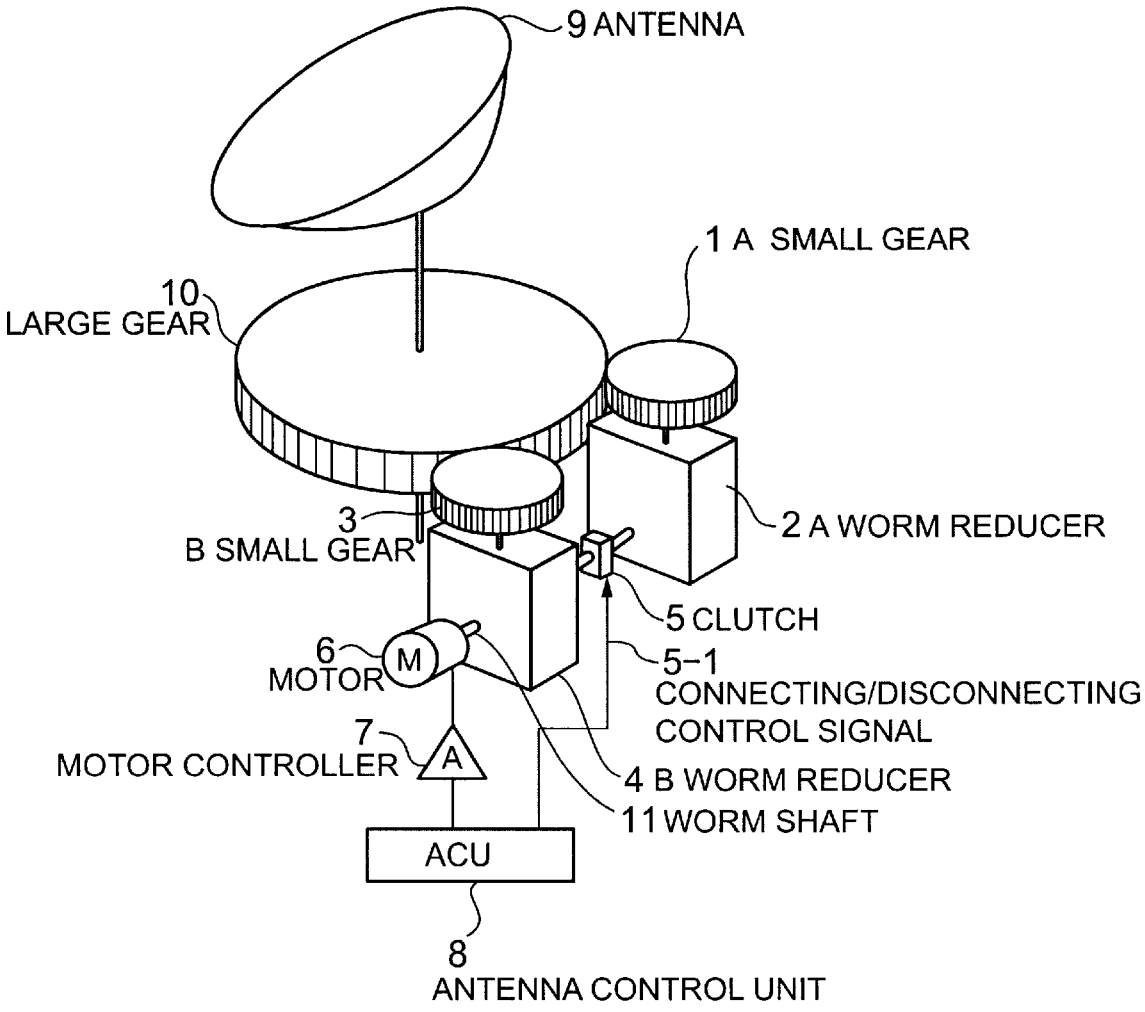
FIG. 5 is a structural diagram of a wide range azimuth (AZ) driving system for an antenna according to a first embodiment of the present invention.

FIG. 5 is a structural diagram of a wide range azimuth (AZ) system for an antenna according to the first embodiment of the present invention.

Referring to FIG. 5, the wide range azimuth (AZ) driving system for the antenna according to the first embodiment of the present invention comprises one large gear 10, two small gears of an A small gear 1 and a B small gear 3, two worm reducers of an A worm reducer 2 and a B worm reducer 4, a motor 6, a clutch 5 for connecting/disconnecting a worm shaft of the two worm reducers of the A worm reducer 2 and the B worm reducer 4, an ACU 8, and a motor controller 7.

The operation of the ACU 8 is different from that of the ACU 19 in points that the motor 6 is driven by controlling the motor controller 7 and a connecting/disconnecting control signal 5-1 for connecting/disconnecting the clutch 5 is outputted in accordance with the azimuth (AZ) driving of an antenna 9.

The motor controller 7 drives the motor 6 under the control operation by the ACU 8. To be more specific, an AC inverter controller can be used as the motor controller 7 and an AC inverter motor can be used as the motor 6. Consequently, the price of the wide range azimuth (AZ) driving system for the antenna can be lower. The motor controller 7 can control a drive voltage and a frequency which are applied to the motor 6 in accordance with the control operation by the ACU 8 and can drive the motor 6 in any desired direction and rotational speed.

Here, the worm reducers will be simply described.

Figure 6:
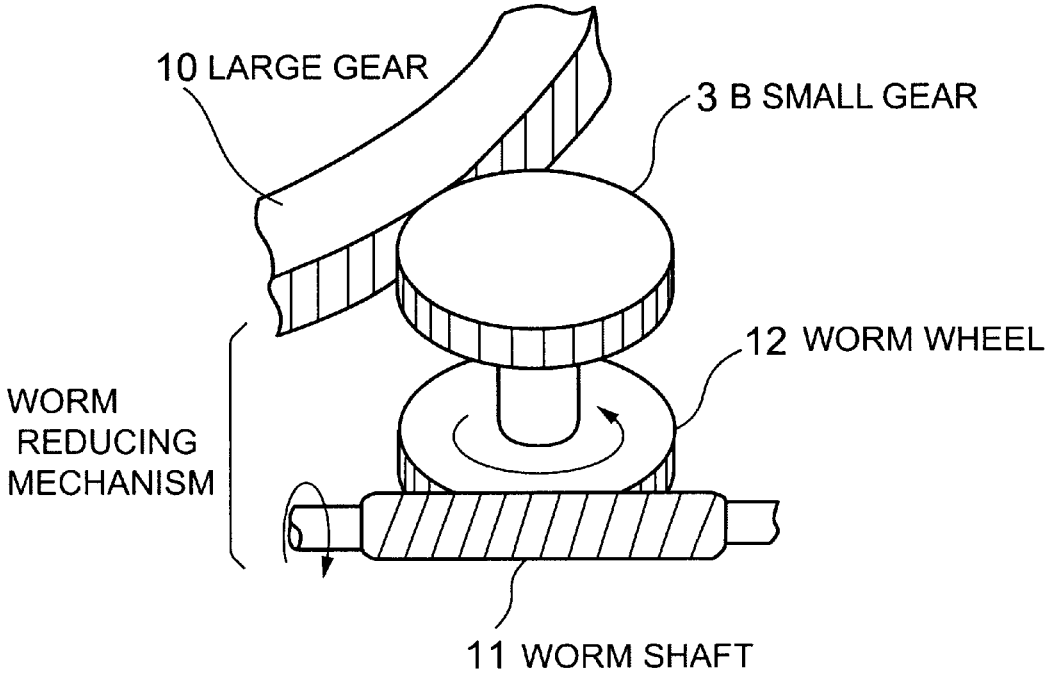
FIG. 6 is a structural diagram of a worm reducer in a wide range azimuth (AZ) driving system for an antenna of the present invention.

FIG. 6 is a schematic diagram showing an internal structure of the B worm reducer 4 shown in FIG. 5.

The B worm reducer 4 comprises a worm shaft 11, a worm wheel 12, and the B small gear 3 which is driven by the worm wheel 12.

Incidentally, FIG. 6 is a schematic diagram. That is, obviously, a worm reducing mechanism can further be provided between the worm wheel 12 and the B small gear 3 if necessity may arise by the well-known technique according to the present embodiment.

Referring to FIG. 6, when the worm shaft 11 is rotated by a driving force of the motor 6, the rotation of the worm shaft 11 is transmitted to the A worm reducer 2 via the clutch 5. The internal structure of the A worm reducer 2 is the same as that of FIG. 6. The worm shaft 11 of the A worm reducer 2 is rotated by a driving force from the clutch 5.

The description returns to the B worm reducer 4. A worm gear is mounted to the worm shaft 11 and, thereby, the worm wheel 12 is driven. The rotation of the worm wheel 12 is transmitted to the B small gear 3, thereby driving the large gear 10.

If the driving force is applied to the B small gear 3 from the large gear 10, the worm shaft 11 of the worm reducer is not rotated by a so-called self-locking function. Because the worm reducer includes the worm gear and the worm wheel.

In this case, the backlash is suppressed between the large gear 10 and the B small gear 3 and between the worm wheel 12 and the worm shaft 11 (worm gear).

Next, referring to FIG. 5 again, the essential points of the structure of the present invention will be described.

According to the wide range azimuth (AZ) driving system for the antenna of the present invention, the self-locking function of the worm reducer is used, thereby, the backlash is suppressed and an error of the direction to which the antenna is directed becomes minimum.

According to the structure of FIG. 5, since the clutch is provided between the two worm reducers of the A worm reducer 2 and the B worm reducer 4, if the motor 6 is driven in a state in which the clutch 5 is disconnected, the driving force is generated to the large gear 10 by the B small gear 3 and the B worm reducer 4 and, on the other hand, the A small gear 1 and the A worm reducer 2 which are disconnected by the clutch 5 are not rotated by the self-locking function.

Therefore, if the backlash between the A small gear 1 and B small gear 3 and the large gear 10 and the backlash in the A worm reducer 2 and the B worm reducer 4 are suppressed, the worm shaft 11 cannot rotate any more. Here, the motor 6 enters a state of an over load and stops rotating.

In the state of the over load of the motor 6, a more drive current value of the motor 6 increases, as compared with a state in which the worm shaft 11 rotates. The ACU 8 detects the drive current value of the motor 6, and if the drive current value is larger than a predetermined value, the ACU 8 detects that the backlash is suppressed and the motor 6 stops.

The ACU 8 connects the clutch 5 and drives the motor 6. Then, the rotation of the worm shaft 11 is transmitted to the A worm reducer 2. The A small gear 1 and the A worm reducer 2 are interlocked to the B small gear 3 and the B worm reducer 4, thereby generating a driving force to the large gear 10.

As mentioned above, the antenna can be driven with high directional-precision in the state in which backlash is absent.

Next, the operation of the wide range azimuth (AZ) driving system for the antenna of the present invention will be described in detail with reference to FIGS. 5 and 7*a* to 7*f*.

FIGS. 7*a* to 7*f* illustrate the control sequence by the ACU 8 in the FIG. 5.

Figure 7A:
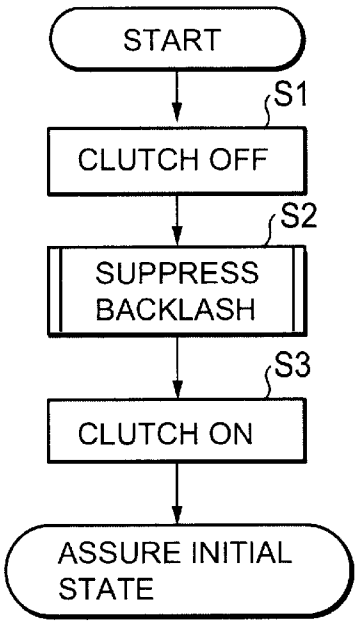
FIG. 7*a* is a flowchart showing a control sequence by an ACU 8 when start of the wide range azimuth (AZ) driving system for the antenna according to the first embodiment of the present invention.

Referring to FIG. 7*a*, when the wide range azimuth (AZ) driving system for the antenna of the present invention is started, the ACU 8 disconnects the clutch 5 (step S1), suppresses backlash (step S2), thereafter, connects the clutch (step S3), and the initial state is assured. In this case, the antenna 9 is made stationary in a state in which the backlash of the mechanism portion is suppressed.

The ACU 8 suppresses backlash as follows.

Referring to FIG; 7*d*, the ACU 8 drives the motor 6 in a prescribed direction in a state in which the clutch 5 is disconnected (step S201). The driving force of the motor 6 is transmitted to the B worm reducer 4 from the worm shaft 11 and the B small gear 3 drives the large gear 10.

After driving the motor 6, the ACU 8 detects a consumption current of the motor 6 (step S202). Since the clutch 5 is disconnected, the self-locking function of the A worm reducer 2 acts as mentioned above. Thus, the load of the motor 6 is excessive while the backlash between the A worm reducer 2 and the B worm reducer 4 and between the A small gear 1 and B small gear 3 and the large gear 10 is suppressed, and the rotation of the worm shaft 11 stops.

When the load of the motor 6 is excessive and the consumption current thereof increases, the ACU 8 determines that the load of the motor 6 reaches the prescribed torque (step S202) and stops the motor 6 (step S203). The backlash is suppressed.

Sequentially, the operation of tracking driving to track the satellite will be described.

Figure 7B:
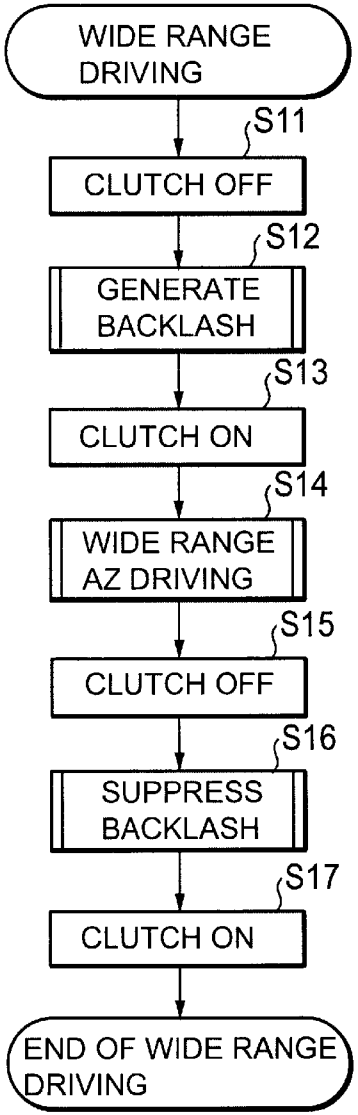
FIG. 7*b* is a flowchart showing a control sequence by the ACU 8 when wide range driving of the wide range azimuth (AZ) driving system for the antenna according to the first embodiment of the present invention.
Figure 7C:
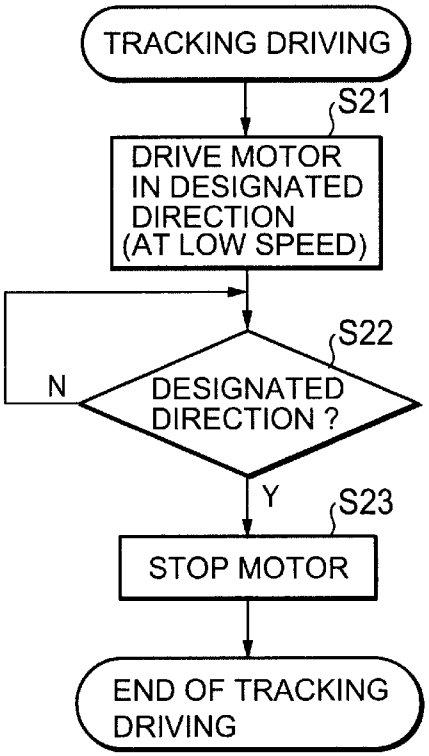
FIG. 7*c* is a flowchart showing a control sequence by the ACU 8 when tracking driving of the wide range azimuth (AZ) driving system for the antenna according to the first embodiment of the present invention.

Referring to FIG. 7*c*, the motor 6 is driven at a predetermined low speed when the tracking driving (step S21), the direction of the antenna is detected (step S22), and the motor 6 is stopped when the antenna 9 is directed in the designated direction (step S23).

When the start of the tracking driving, in the mechanism portion of the wide range azimuth (AZ) driving system of the present invention, the clutch 5 is connected in a state in which the backlash is suppressed. Therefore, the motor 6 is driven and, then, the A worm reducer 2 is interlocked to the B worm reducer 4 by a driving force of the motor 6, thereby driving the large gear 10. Since the large gear 10 is driven while the backlash is suppressed, the precision of the direction to which the antenna is directed can be held to be high during the tracking driving.

Accordingly, the antenna 9 can continuously communicate data even during the tracking driving.

Sequentially, the operation of the wide range driving will be described.

Referring to FIG. 7*b*, when the wide range driving, the ACU 8 first generates backlash (step S12), rotates the antenna 9 in the designated direction by the wide range azimuth (AZ) driving (step S14), thereafter, the backlash is suppressed again (step S16), and the wide range driving stops.

Herein, the operation for generating the backlash will be described.

According to the wide range azimuth (AZ) driving system for the antenna of the present invention, the control operation is performed so that the mechanism portion has backlash in advance when the large gear 10 is driven throughout the wide range.

This is the reason why a large gear having not so high pitch-precision can be adopted to the large gear 10 in the wide range azimuth (AZ) driving system of the present invention and the manufacture is possible with lower costs. As one example, a large gear having pitch-precision of approximately seven-degree is adopted to the large gear 10 in the wide range azimuth (AZ) driving system for the antenna of the present invention.

This depends on the trade-off relationship between precision and costs shown as follows.

First, the precision is mentioned above for the following reason. It is difficult that the large gear 10 with the foregoing precision is driven all over the azimuth (AZ) direction (within the range of 360° ) while the backlash is suppressed (that is, the driving is difficult in the half way because the phase of the A small gear 1 deviates from one of the B small gear 3 depending on the precision of the large gear 10 and the worm reducers enters the self-locked state in the case of the wide range driving). However, the foregoing precision is sufficient to drive the antenna while the backlash of the mechanism portion is suppressed within the azimuth (AZ) tracking range of the tracking driving (range of an azimuth angle of approximately 6°)

The costs is mentioned above for the following reason. That is, the large gear 10 uses a gear used for a tuning mechanism portion of a crane, etc. which is generally called as "tuning wheel". The "tuning wheel" having pitch precision of approximately 7-degree is produced as a standard specification product and is widely supplied. Therefore, in this case, the "tuning wheel " is obtained at a lower price, as compared with the case of individually manufacturing the tuning wheel having further high precision.

Referring to FIG. 7*b* again, the ACU 8 disconnects the clutch 5 (step S11), generates the backlash (step S12), and, thereafter, connects the clutch 5 (step S13).

Figure 7D:
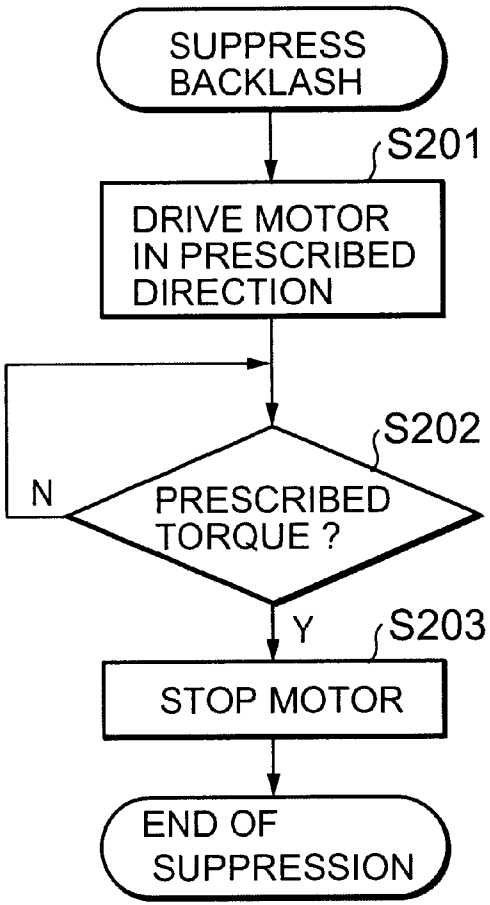
FIG. 7*d* is a flowchart showing a control sequence by the ACU 8 in a step of suppressing backlash in FIGS. 7*a* and 7*b;*
Figure 7E:
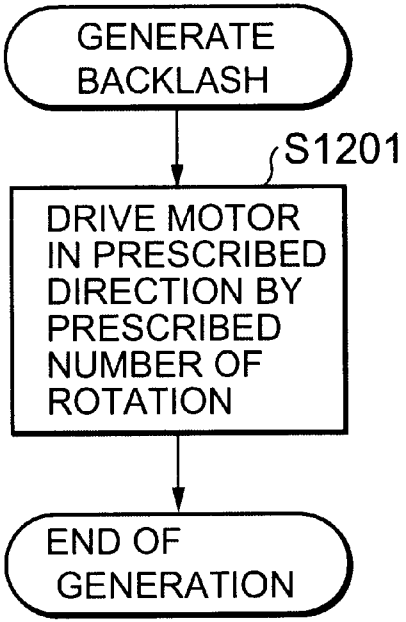
FIG. 7*e* is a flowchart showing a control sequence by the ACU 8 in a step of generating the backlash in FIG. 7*b;*

Referring to FIG. 7*e*, the ACU 8 drives the motor 6 in a prescribed rotational direction (direction in which the backlash is to be generated) by a prescribed rotary number in order to generate the backlash (step S1201). In this case, the clutch 5 is disconnected, so that only the B worm reducer 4 is driven by the rotation of the worm shaft 11 and a predetermined amount of backlash is generated to the mechanism portion.

Next, the operation of the wide range azimuth (AZ) driving will be described.

Figure 7F:
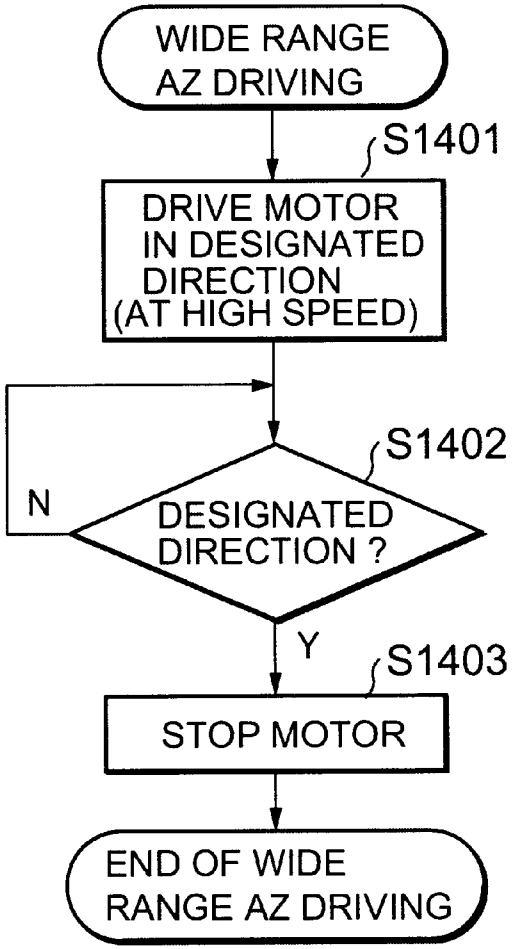
FIG. 7*f* is a flowchart showing a control sequence by the ACU 8 in a step of the wide range azimuth (AZ) driving in FIG. 7*b;*

Referring to FIG. 7*f*, when the wide range azimuth (AZ) driving, the ACU 8 drives the motor 6 in the designated direction at a high speed (step S1401), detects the direction to which the antenna 9 is directed (step S1402), and the motor 6 is stopped when the antenna 9 is directed in the designated direction (step S1403). When the wide range azimuth (AZ) driving, the mechanism portion drives the large gear 10 with a proper amount of backlash, so that the antenna 9 can be driven all over the area in the azimuth (AZ) direction.

Obviously, the moment of inertia of the antenna 9 is properly suppressed when the motor 6 is started and stopped and, therefore, the acceleration and deceleration of the motor 6 can be properly controlled by a well-known technique.

Referring to FIG. 7*b* again, the wide range azimuth (AZ) driving ends (step S14), then, the ACU 8 disconnects the clutch 5(step S15) and suppresses the backlash (step S16), thereafter, the clutch 5 is connected again (step S17), and the wide range driving ends.

The operations for suppressing the backlash in steps S15 to S17 are similar to those in steps S1 to S3 in FIG. 7*a* and that in steps S201 to S203 in FIG. 7*d*. Therefore, the detailed description is omitted.

Although the large gear 10 is what is called an external gear and the A small gear 1 and the B small gear 3 are disposed at the outside of the large gear 10 in the above-mentioned description, there is a "tuning wheel" of what is called an internal gear type which is generally produced and supplied. According to the embodiment of the present invention, obviously, the similar advantage can be obtained by using the large gear 10 of the internal gear type and disposing the A small gear 1 and the B small gear 3 to the inside of the large gear 10.

Although the A worm reducer 2, the B worm reducer 4, the A small gear 1, and the B small gear 3 are arranged to the antenna tower and the large gear 10 is arranged to the antenna yoke in the above description, the A worm reducer 2, the B worm reducer 4, the A small gear 1, and the B small gear 3 may be arranged to the antenna yoke and the large gear 10 may be arranged to the antenna tower.

Although the worm shaft 11 penetrates through the B worm reducer 4 and one end of the worm shaft 11 is driven by the motor 6 and the other end thereof is connected to the clutch 5 in the above description, both the A worm reducer 2 and the B worm reducer 4 can use the reducers of worm shafts of non-penetrating type if the motor 6 of a rotary-shaft penetrating type is adopted and the motor 6 is disposed between the B worm reducer 4 and the clutch 5. In this case, the rotational direction of the worm shaft and the rotational direction of the small gear of the A worm reducer 2 are opposite to those of the B worm reducer 4.

Obviously, the above incidental items can similarly be applied to the other embodiment of the present invention, which will be described hereinbelow.

A second embodiment of the present invention will be described with reference to the drawings.

Figure 8:
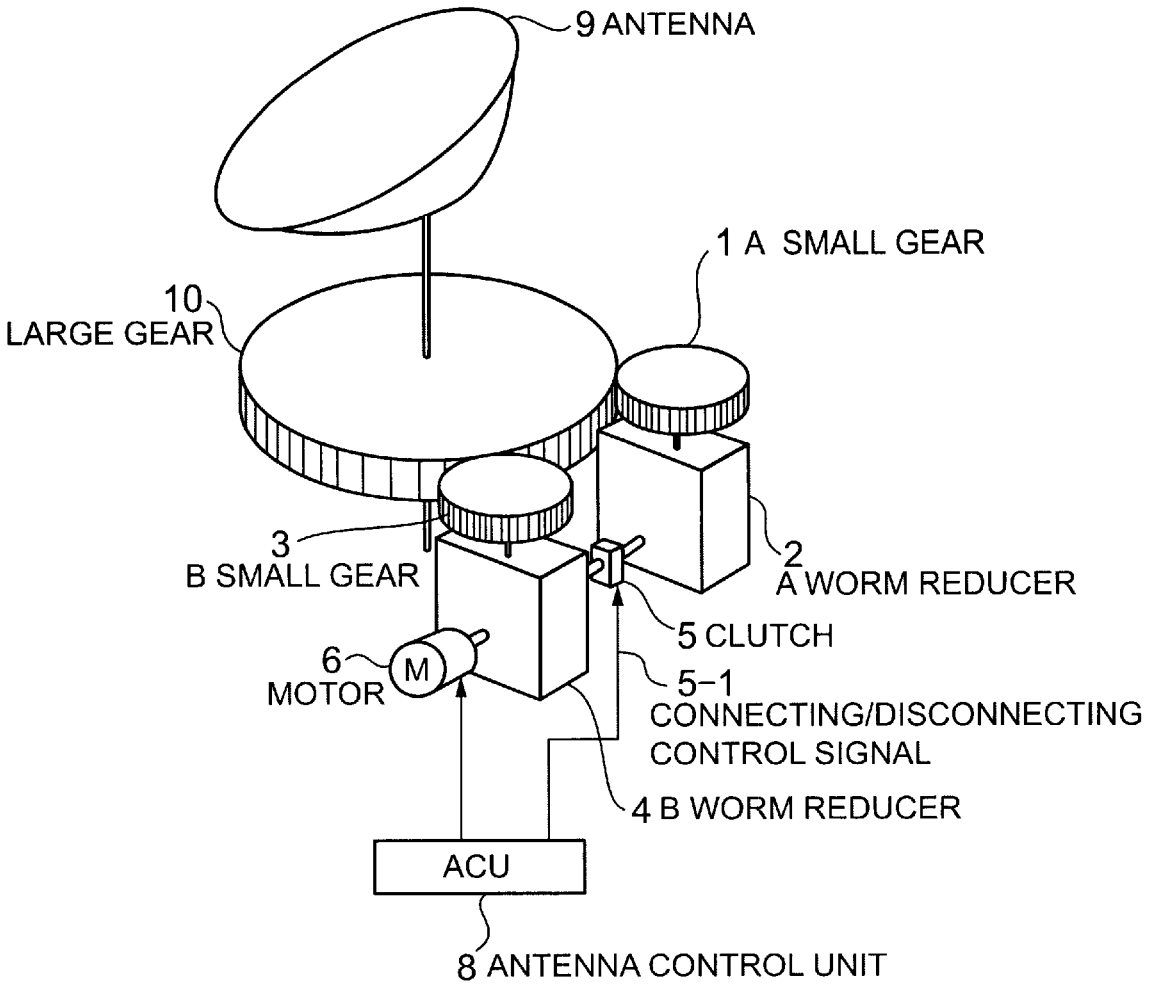
FIG. 8 is a structural diagram of a wide range azimuth (AZ) driving system for an antenna according to a second embodiment of the present invention.

FIG. 8 is a structural diagram of a wide range azimuth (AZ) driving system for an antenna according to the second embodiment of the present invention.

Referring to FIG. 8, the wide range azimuth (AZ) driving system for the antenna according to the second embodiment of the present invention comprises one large gear 10, two small gears of an A small gear 1 and a B small gear 3, two worm reducers of an A worm reducer 2 and a B worm reducer 4, a motor 6, a clutch 5 for connecting/disconnecting worm shafts of the A worm reducer 2 and the B worm reducer 4, and an ACU 8.

The wide range azimuth (AZ) driving system for the antenna according to the second embodiment of the present invention adopts a more simple structure by excluding a motor controller 7 from the first embodiment.

The structure is mainly applied and more costs can be lowered when the rotational speed of the antenna is not required in the case of the wide range driving.

The ACU 8 according to the second embodiment of the present invention controls only the start and stop and the rotational direction of the motor 6. Therefore, the motor 6 is driven at the same predetermined speed in the cases of both the wide range driving and the tracking driving.

The operation of FIG. 8 will be simply described with reference to FIGS. 9*a* to 9*f*.

Figures 9A, 9B, 9C:
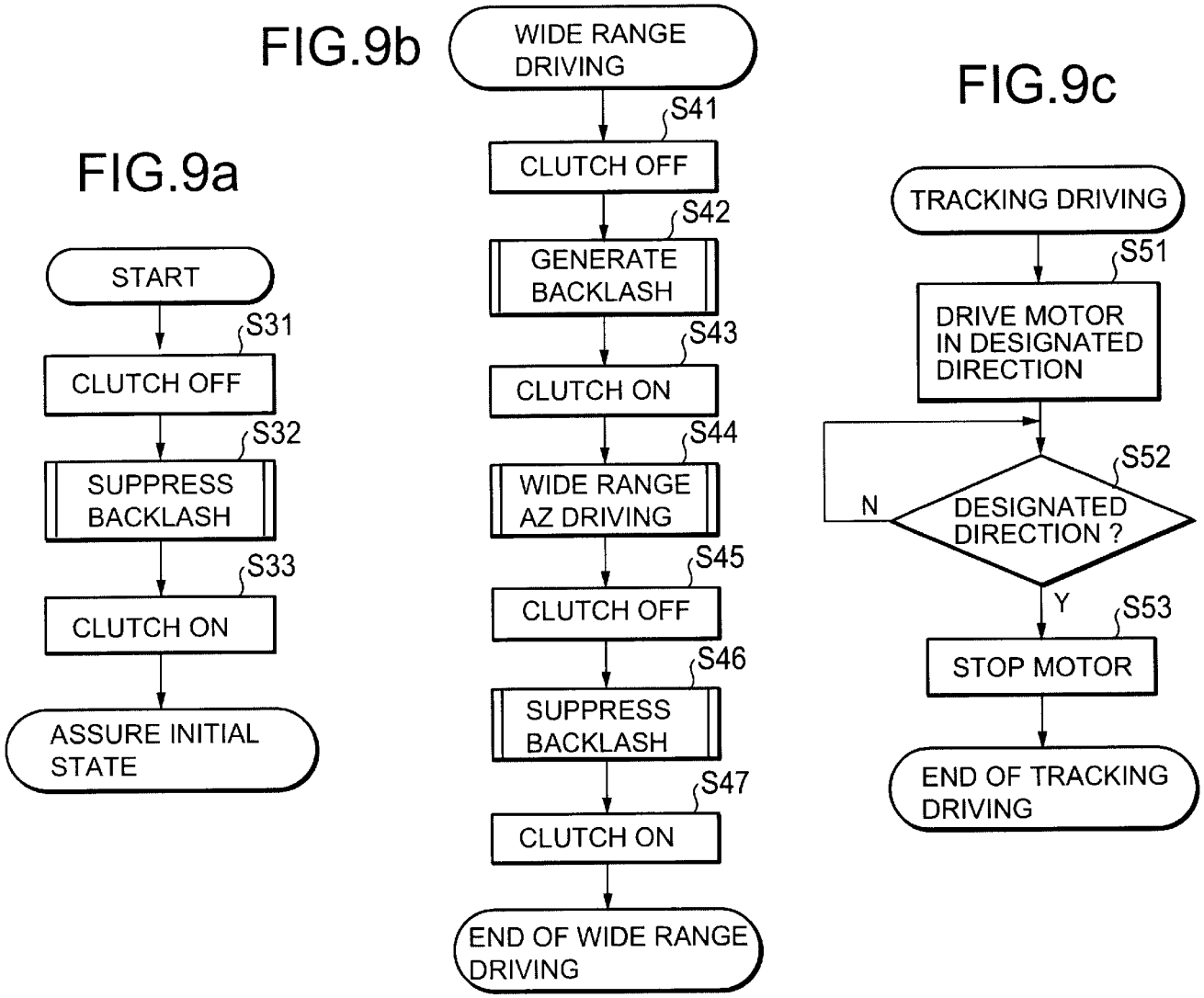
FIG. 9*a* is a flowchart showing a control sequence by the ACU 8 when start of the wide range azimuth (AZ) driving system for the antenna according to the second embodiment of the present invention.
FIG. 9*b* is a flowchart showing a control sequence by the ACU 8 when wide range driving of the wide range azimuth (AZ) driving system for the antenna according to the second embodiment of the present invention.
FIG. 9*c* is a flowchart showing a control sequence by the ACU 8 when tracking driving of the wide range azimuth (AZ) driving system for the antenna according to the second embodiment of the present invention.
Figure 9D:
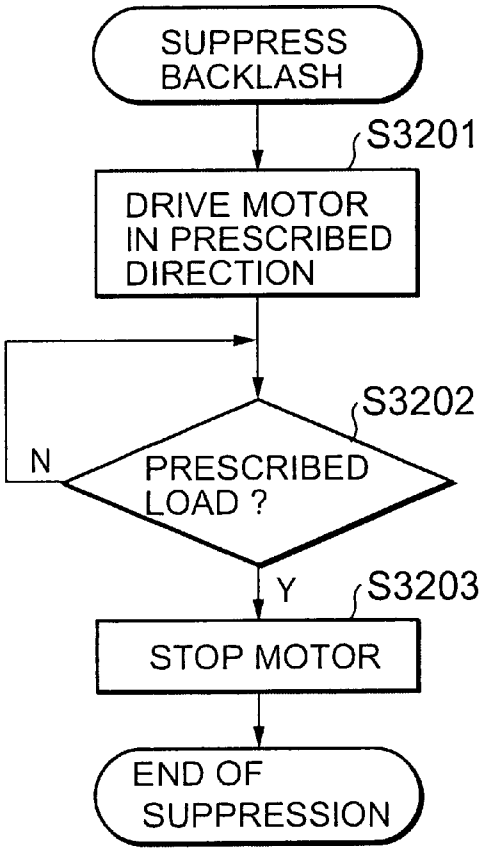
FIG. 9*d* is a flowchart showing a control sequence by the ACU 8 in a step of suppressing backlash in FIGS. 9*a* and 9*b;*
Figure 9E:
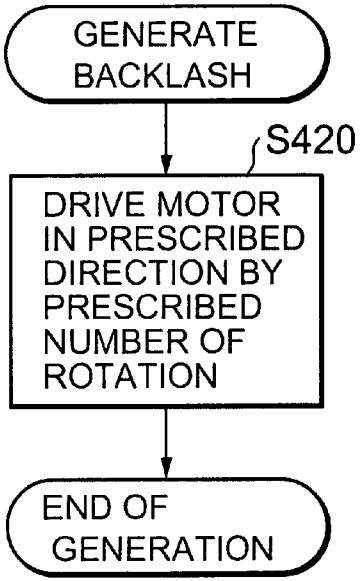
FIG. 9*e* is a flowchart showing a control sequence by the ACU 8 in a step of generating the backlash in FIG. 9*b*.

The operations when the starting (in steps S31 to S33 and steps S3201 to S3203) shown in FIGS. 9*a* and 9*c* are similar to those described in FIGS. 7*a* and 7*d*.

Figure 9F:
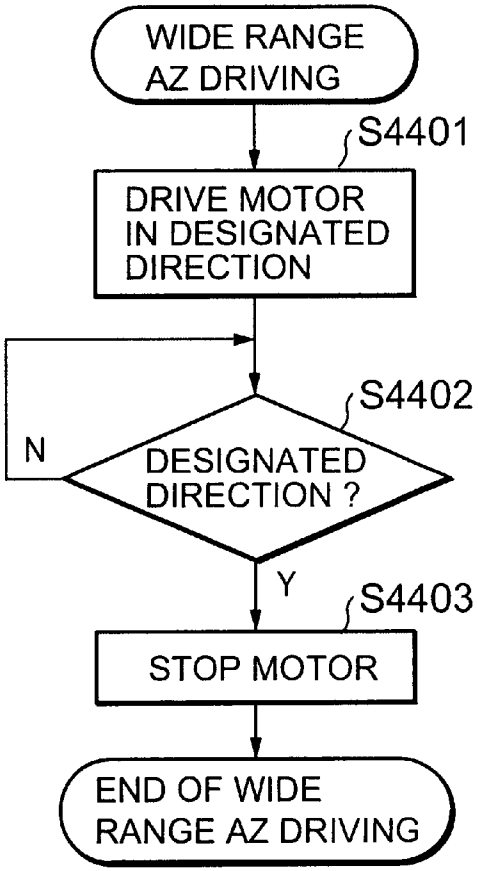
FIG. 9*f* is a flowchart showing a control sequence by the ACU 8 in a step of the wide range azimuth (AZ) driving in FIG. 9*b*.

The operations when the wide range driving (in steps S41 to S47, steps S3201 to S3203, steps S4201, and steps S4401 to S4403) shown in FIGS. 9*b*, 9*c*, and 9*f* are performed by the same sequence as those in FIGS. 7*b* and 7*d* to 7*f*. However, FIG. 9*f* is different from FIG. 7*f* in a point that the driving speed of the motor 6 is a predetermined speed (step S4401).

The operation of the tracking driving shown in FIG. 9*c* is performed by the same sequence as the sequence which is described in FIG. 7*c*. However, the operation in FIG. 9*c* is different from that in FIG. 7*c* in a point that a driving speed of the motor 6 is a predetermined speed (step S51).

The motor 6 in the wide range azimuth (AZ) driving system for the antenna according to the second embodiment of the present invention can be constructed by an AC motor whose cost is lower than that according to the first embodiment of the present invention. Thus, more costs of the structure can be lowered.

A prescribed load when the backlash is suppressed may be detected by, for example, arranging a torque detector to the worm shaft 11 and using the torque load, not using a drive current value.

As mentioned above, the wide range azimuth (AZ) driving system for the antenna according to the first embodiment of the present invention has specific operation and advantage that the costs can be reduced because of the adoption of the simple structure and the manufacturing period can be shortened because the balance adjusting operation of the driving forces of a plurality of motors is unnecessary.

The wide range azimuth (AZ) driving system for the antenna according to the second embodiment of the present invention has further simple structure as compared with that of the wide range azimuth (AZ) driving system for the antenna according to the first embodiment of the present invention. Therefore, more costs can be reduced.

Since the balance adjusting operation of the driving forces of a plurality of motors is unnecessary, the wide range azimuth (AZ) driving system for the antenna according to the second embodiment of the present invention has specific operation and advantage that the manufacturing period can be shortened similarly to the wide range azimuth (AZ) driving system for the antenna according to the first embodiment of the present invention.

While this invention has been described in connection with certain preferred embodiments, it is to be understood that the subject matter encompassed by way of this invention is not to be limited to those specific embodiments.

On the contrary, it is intended for the subject matter of the invention to include all alternative, modification and equivalents as can be included within the spirit and scope of the following claims.

What is claimed is:

1. A wide range azimuth driving system for an antenna in which the antenna rotates in an azimuth direction, including:

a plurality of worm reducing means which is arranged to an antenna tower and drives a first gear by worm reduction due to rotation of a worm shaft; and a second gear which is arranged to an antenna yoke and engages with a plurality of said first gears.

2. A wide range azimuth driving system for an antenna in which the antenna rotates in an azimuth direction, including:

first worm reducing means which is arranged to an antenna tower and drives a first gear by worm reduction due to rotation of one end of a first worm shaft;

connecting/disconnecting means which is connected to the other end of said first worm shaft and intermittently transmits a rotational force of said first worm shaft which is taken to one end thereof to the other end thereof in accordance with a control operation from outside;

second worm reducing means which is connected to the other end of said connecting/disconnecting means and drives a second gear by worm reduction due to rotation of a second worm shaft which is caused by a rotational force of the other end of said connecting/disconnecting means; and a third gear which is arranged to an antenna yoke, and engages with both said first gear and said second gear.

3. A wide range azimuth driving system for an antenna according to claim 2, further including:

driving means which is arranged to the antenna tower and rotates the one end of said first worm shaft; and antenna control means which controls rotational direction, start, and stop of said driving means by a control operation from outside and also controls said connecting/disconnecting means.

4. A wide range azimuth driving system for an antenna according to claim 2, further including:

driving means which is arranged to the antenna tower and rotates the one end of said first worm shaft; and antenna control means which controls rotational direction and rotational speed of said driving means by a control operation from outside and also controls said connecting/disconnecting means.

5. A wide range azimuth driving system for an antenna in which the antenna rotates in an azimuth direction, including:

driving means which is arranged to an antenna tower and has a rotary shaft of a penetrating type;

first worm reducing means which is connected to one end of the rotary shaft of said driving means and drives a first gear by worm reduction due to rotation of a first worm shaft;

connecting/disconnecting means which is connected to the other end of the rotary shaft of said driving means and intermittently transmits a rotational force of the rotary shaft of said driving means which is taken to one end thereof to the other end thereof in accordance with a control operation from outside;

second worm reducing means which is connected to the other end of said connecting/disconnecting means and drives a second gear by worm reduction due to rotation of a second worm shaft which is caused by a rotational force of the other end of said connecting/disconnecting means; and a third gear which is arranged to an antenna yoke and engages with both said first gear and said second gear.

6. A wide range azimuth driving system for an antenna according to claim 5, further including antenna control means which controls rotational direction, start, and stop of said driving means by a control operation from outside and also controls said connecting/disconnecting means.

7. A wide range azimuth driving system for an antenna according to claim 5, further including antenna control means which controls rotational direction and rotational speed of said driving means by a control operation from outside and also controls said connecting/disconnecting means.

8. A wide range azimuth driving system for an antenna in which the antenna rotates in an azimuth direction, including:

a plurality of worm reducing means which is arranged to an antenna yoke and drives a first gear by worm reduction due to rotation of a worm shaft; and a second gear which is arranged to an antenna tower and engages with a plurality of said first gears.

9. A wide range azimuth driving system for an antenna in which the antenna rotates in an azimuth direction, including:

first worm reducing means which is arranged to an antenna yoke and drives a first gear by worm reduction due to rotation of one end of a first worm shaft;

connecting/disconnecting means which is connected to the other end of said first worm shaft and intermittently transmits a rotational force of said first worm shaft which is taken to one end thereof to the other end thereof in accordance with a control operation from outside;

second worm reducing means which is connected to the other end of said connecting/disconnecting means and drives a second gear by worm reduction due to rotation of a second worm shaft which is caused by a rotational force of the other end of said connecting/disconnecting means; and a third gear which is arranged to an antenna tower and engages with both said first gear and said second gear.

10. A wide range azimuth driving system for an antenna according to claim 9, further including:

driving means which is arranged to the antenna yoke and rotates the one end of said first worm shaft; and antenna control means which controls rotational direction, start, and stop of said driving means from a control operation from outside and also controls said connecting/disconnecting means.

11. A wide range azimuth driving system for an antenna according to claim 9, further including:

driving means which is arranged to the antenna yoke and rotates the one end of said first worm shaft; and antenna control means which controls rotational direction and rotational speed of said driving means by a control operation from outside and also controls said connecting/disconnecting means.

12. A wide range azimuth driving system for an antenna in which the antenna rotates in an azimuth direction, including:

driving means which is arranged to an antenna yoke and has a rotary shaft of a penetrating type;

first worm reducing means which is connected to one end of the rotary shaft of said driving means and drives a first gear by worm reduction due to rotation of a first worm shaft;

connecting/disconnecting means which is connected to the other end of the rotary shaft of said driving means and intermittently transmits a rotational force of the rotary shaft of said driving means which is taken to one end thereof to the other end thereof in accordance with a control operation from outside;

second worm reducing means which is connected to the other end of said connecting/disconnecting means and drives a second gear by worm reduction due to rotation of a second worm shaft which is caused by a rotational force of the other end of said connecting/disconnecting means; and a third gear which is arranged to an antenna tower and engages with both said first gear and said second gear.

13. A wide range azimuth driving system for an antenna according to claim 12, further including antenna control means which controls rotational direction, start, and stop of said driving means by a control operation from outside and also controls said connecting/disconnecting means.

14. A wide range azimuth driving system for an antenna according to claim 12, further including antenna control means which controls rotational direction and rotational speed of said driving means by a control operation from outside and also controls said connecting/disconnecting means.

15. A driving method for a wide range azimuth driving system for an antenna in which the antenna rotates in an azimuth direction having first worm reducing means which is arranged to an antenna tower and drives a first gear by worm reduction due to rotation of a first worm shaft, second worm reducing means which drives a second gear by worm reduction due to rotation of a second worm shaft, and a third gear which is arranged to an antenna yoke and engages with both said first gear and said second gear, including the steps of:

driving one of said first and second worm shafts; and suppressing backlash between said first and second worm reducing means and said third gear.

16. A driving method for a wide range azimuth driving system for an antenna according to claim 15 wherein said system has connecting/disconnecting means which is connected to said first worm shaft and intermittently transmits a rotational force of said first worm shaft which is take to one end thereof to the other end thereof in accordance with a control operation from outside and said second worm shaft is connected to said other end which said connecting/disconnecting means has, further including the steps of:

controlling to disconnect said connecting/disconnecting means;

suppressing backlash between said third gear and said first and second worm reducing means by rotation of one of said first and second worm shafts;

controlling to connect said connecting/disconnecting means; and interlocking said first worm reducing means to said second worm reducing means and driving said third gear by rotating one of said first and second worm shafts which is connected by said connecting/disconnecting means.

17. A driving method for a wide range azimuth driving system for an antenna according to claim 15, further including the steps of:

controlling to disconnect said connecting/disconnecting means;

generating a predetermined amount of backlash on engagement with said third gear and said first and second worm reducing means by rotation of one of said first worm shaft and said second worm shaft;

controlling to connect said connecting/disconnecting means; and interlocking said first worm reducing means to said second reducing means and driving said third gear by rotation of one of said first worm shaft and said second worm shaft which is connected by said connecting/disconnecting means.

18. A driving method for a wide range azimuth driving system for an antenna in which the antenna rotates in an azimuth direction having first worm reducing means which is arranged to an antenna yoke and drives a first gear by worm reduction due to rotation of a first worm shaft, second worm reducing means which drives a second gear by worm reduction due to rotation of a second worm shaft, and a third gear which is arranged to an antenna tower and engages with both said first gear and said second gear, including the steps of:

driving one of said first and second worm shafts; and suppressing backlash between said first and second worm reducing means and said third gear.

19. A driving method for a wide range azimuth driving system for an antenna according to claim 18 wherein said system has connecting/disconnecting means which is connected to said first worm shaft and intermittently transmits a rotational force of said first worm shaft which is taken to one end thereof to the other end thereof in accordance with a control operation from outside and said second worm shaft is connected to said other end which said connecting/disconnecting means has, further including the steps of:

controlling to disconnect said disconnecting/disconnecting means;

suppressing backlash between said third gear and said first and second worm reducing means by rotation of one of said first and second worm shafts;

controlling to connect said connecting/disconnecting means; and interlocking said first worm reducing means to said second worm reducing means and driving said third gear by rotating one of said first and second worm shafts which is connected by said connecting/disconnecting means.

20. A driving method for a wide range azimuth driving system for an antenna according to claim 18, further including the steps of:

controlling to disconnect said connecting/disconnecting means;

generating a predetermined amount of backlash on engagement with said third gear and said first and second worm reducing means by rotation of one of said first worm shaft and said second worm shaft;

controlling to connect said connecting/disconnecting means; and interlocking said first worm reducing means to said second reducing means and driving said third gear by rotation of one of said first worm shaft and said second worm shaft which is connected by said connecting/disconnecting means.

* * * * *